United States Patent [19]

Stork

[11] 4,416,363

[45] Nov. 22, 1983

[54] VENDING MACHINE WITH SEPARATE INTERLOCKING SECTIONS

[75] Inventor: Sven Stork, Siegen, Fed. Rep. of Germany

[73] Assignee: Electrolux Siegen GmbH, Siegen, Fed. Rep. of Germany

[21] Appl. No.: 165,751

[22] Filed: Jul. 3, 1980

[30] Foreign Application Priority Data

Jul. 9, 1979 [DE] Fed. Rep. of Germany ..... 2927696

[51] Int. Cl.[3] ..... G07F 7/02; G07F 11/62

[52] U.S. Cl. ..... 194/4 D; 221/2, 221/69

[58] Field of Search ..... 194/4 R, 4 B–4G, 194/DIG. 6; 221/2, 5, 69; 222/2

[56] References Cited

U.S. PATENT DOCUMENTS 4,046,242 9/1977 Ahlström ..... 194/4 R 4,194,612 3/1980 Ahlström ..... 194/4 R

*Primary Examiner*—F. J. Bartuska

*Attorney, Agent, or Firm*—Balogh, Osann, Kramer, Dvorak, Geneva & Traub

[57] ABSTRACT

A vending machine with separate lockable storage sections and an actuating key for insertion into the vending machine and unlocking the sections, the actuating key having a workable matrix, and a stamping mechanism which is actuatable by removal of an article from an unlocked section to mark an appropriate imprint on the matrix.

7 Claims, 9 Drawing Figures

Fig. 6
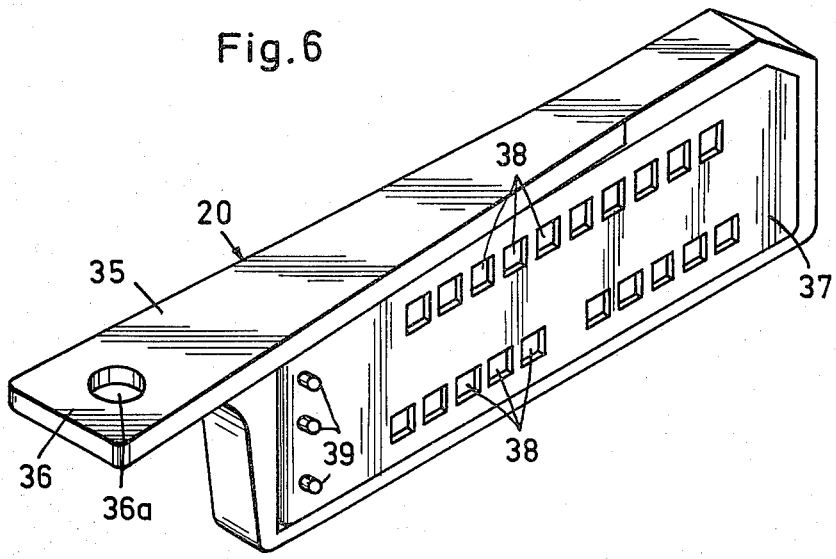
Fig. 7A
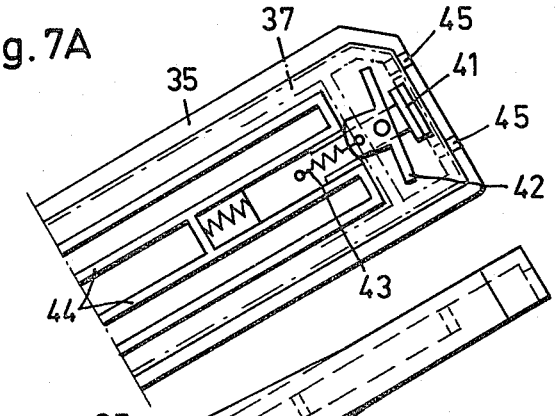
Fig. 7B
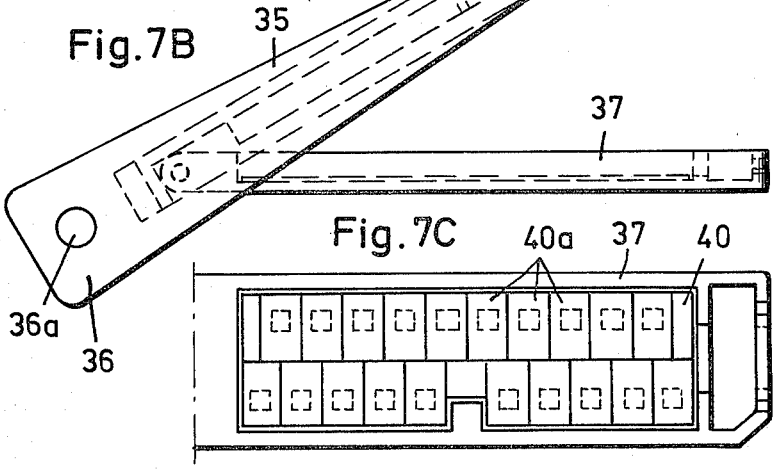
Fig. 7C

VENDING MACHINE WITH SEPARATE INTERLOCKING SECTIONS

This invention relates to a vending machine having separate interlockable article carrying sections, with leverage or control means for both locking and unlocking of locking elements for each section, and a stamping mechanism which contains a plurality of stamping punches corresponding to number of sections in the machine. The stamping punches are operated by horizontal swinging movement of corresponding locking elements when an article is withdrawn from the vending machine, with an interlocking device for leverage and with an actuating key device, which operates the interlocking device at the moment of insertion into the orifice correspondingly provided in the housing. This simultaneously unlocks the section locking elements. The actuating key device is divided into spaces or matrix sections for appropriate stamping punches.

Such vending machine might be placed in hotel rooms or other places available only for limited numbers of people and it provides the possibility of self-service withdrawal of alcoholic and/or non-alcoholic beverages, packaged food products, cigarettes, etc. from the vending machine.

There is known in the art a vending machine described in German Patent Publication DE OS 26 26 941 and which includes article containers disposed in sections. Each single section includes rows one above another in which bottles or articles of different sizes can be placed. In every section, there is provided a separate locking device consisting of pivotable door mounted on an axle. The axles for each pivotable door are located concentrically one inside another and they are rotated upon bottle withdrawal and turning of a swinging door to a predetermined angle. Printing or stamping punches are connected with the axles by a turning lever. Each of the printing or stamping punches is operated on its relative axle pivot and stamps a mark on a matrix position determined in advance. An interlocking device in working position prevents the movement of a stamping punch operating lever. By means of inserting charge card fitted for the vending machine, the interlocking device is disengaged by the releasing mechansim, so that bottles or articles can be withdran from vending machine. In the process of withdrawal of the article, a corresponding stamping punch is operated by means of swinging door and axle pivot and the punch at this time stamps a mark on a particular portion or section of the charge card.

This vending machine provides an advantage in that the hotel guests can pay for purchased drinks and food products along with the room bills, and the charge card is used as proof of purchase. Tampering or attempting to obtain contents from the vending machine by inserting a counterfeit card in the form of a plate and solid cardboard strip similar to the external features of the charge card is prevented by a rock bar which is magnetically attracted at the moment insertion of a proper charge card (with properly located magnetic strips.) For this purpose there is used a magnet installed on the swing arm passing through orifices in the swing plate and having rock bar slot.

Though this known vending machine has advantages compared with other vending machines it has, however, some disadvantages including extremely high hardware cost especially because of presence of both hollow axles concentrically located one inside another and the magnetic safety device. Furthermore, in the prior art device the credit cards are often unintentionally carried away by hotel guests or lost so that the purchases of goods from the machine are either not recorded or not correctly charged. Furthermore, the charge cards themselves are relatively expensive, because of their triple featured function, namely, interlocking device operating, used bottle indicating by means of using stamped marks, and rock bar operating by means of built in card magnet.

It is the object of the present invention to improve the type of vending machine of the prior art, so that both the hardware and maintenance costs are decreased.

This object according to the present invention is solved in that the leverage has one push rod formed by a metal sheet web per one locking element of one row. In this case all separate push rods are placed one above another in the housing with the possibility of longitudinal movement and locking elements, formed as a pivot levers, are mounted on them with usage of one pin per element.

The interlocking device has an angular lever which is engaged with a vertical locking bar and a minimum of one anti-theft plate, which unlocks the angular lever overcoming spring force affecting the vertical locking bar. An actuating key for operating the anti-theft plates, is made in the form of a solid housing, having orifices located on one side and an interchangeable stamping matrix, mounted inside the housing which the user cannot charge by himself.

Separate push rods can be stamped in the form of webs from metal sheet. Their packetwise location one above another inside the housing decreases the necessary space for leverage, comparing with concentrically located axles, whereas it becomes possible to provide joint interlocking of all the push rods by one locking bar movable in vertical plane.

Operation of the vending machine by use of a counterfeit actuating key is prevented first by providing tappets on the antitheft plates, the form and location of which particularly fit the actuating key housing shape, and second by short tappets serving as a key-bit mounted on the side of actuating key cover.

The actuating key, made in the form of a blunt wedge, is provided with orifices adjacent on one side of the cover, which orifices are accessible by different stamping punches. The operation of opening and closing mechanism for simple matrix interchange is by means of special tools.

In addition to the application of a simple and inexpensive paper matrix, the actuating key according to the invention provides one more advantage that is based on its dimensions especially suitable as a key holder for a hotel key, so that loss or unintentional matrix withdrawal by the hotel guests can be avoided with high reliability.

Generally, the vending machine is equipped with a refrigerator.

Based on the drawings a practical example of the invention will be described below in details.

Figure 1:
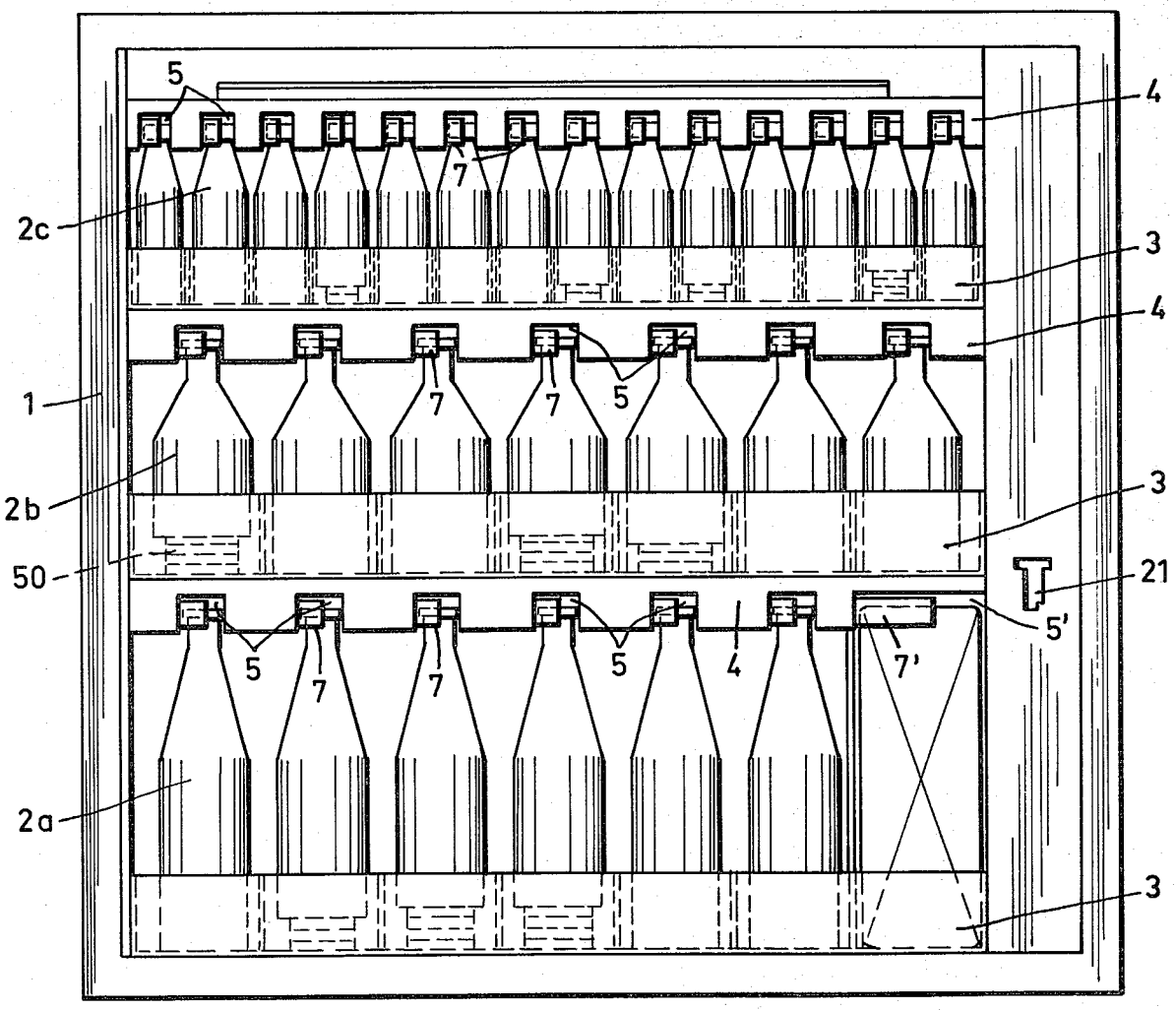
FIG. 1 is a general view of the vending machine of this invention.
Figure 4:
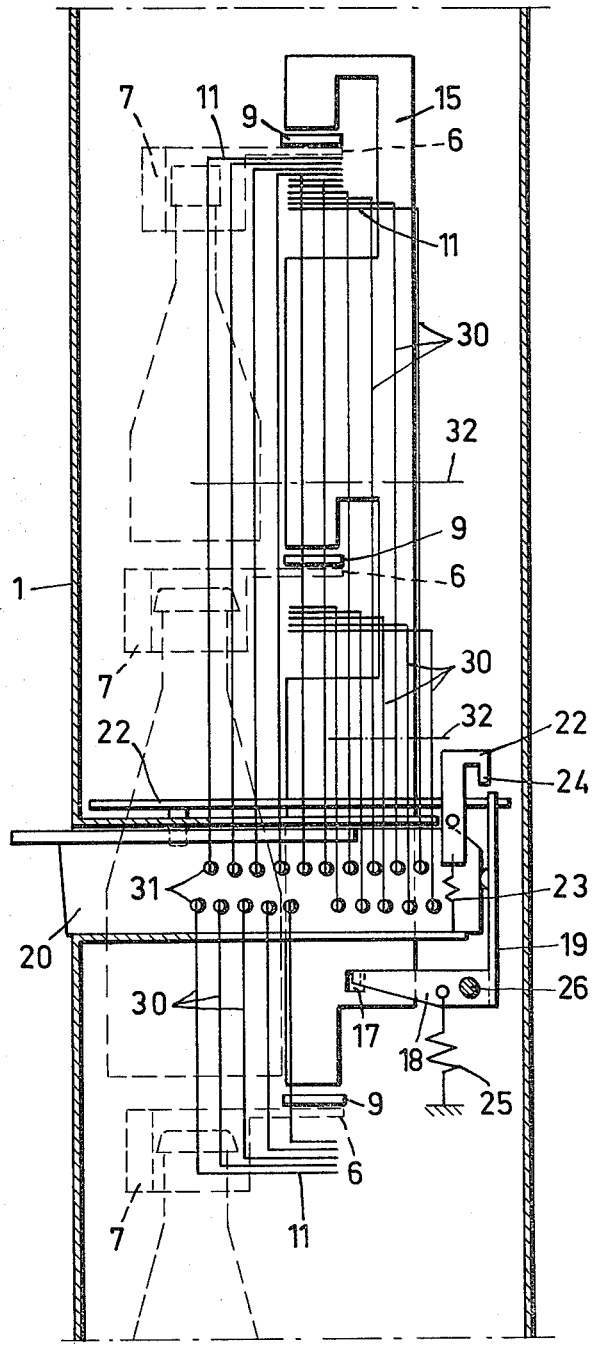
Figure 5:
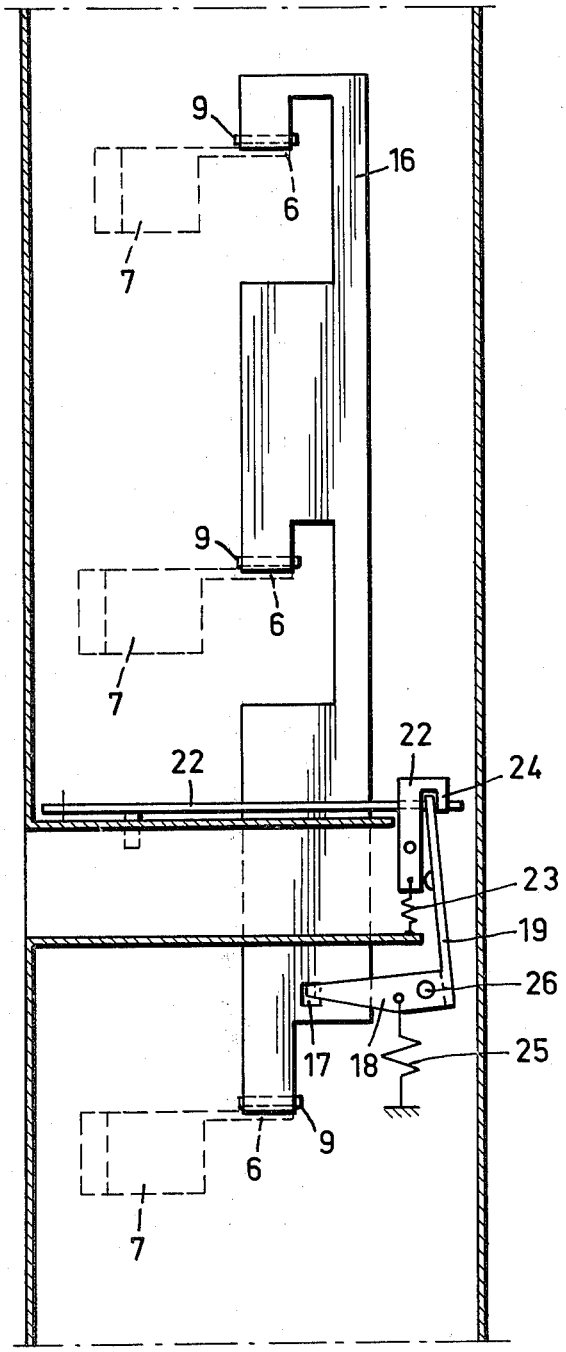

FIG. 4 presents a schematically simplified side view of interlocking device of FIG. 1, FIG. 5 is a partial view of the interlocking device of FIG. 1, FIG. 6 is a perspective view of the charge card or actuating key, and FIG. 7B is a side view of open charge card key with charge card shown in FIG. 7C and closing mechanism shown in FIG. 7A.

Vending machine shown on FIG. 1 consists of a rigid frame or housing 1, in which a number of different size bottles 2*a*, 2*b*, 2*c* are located in horizontally in three rows. Bottles 2 are placed upon edge channel bars 3, secured in the frame and used as so called bottle baskets. On the channel bar bottom, side guide beams 4 having the same channel section are mounted. These beams have slots 5 for bottle neck passage on one side.

Figure 2:
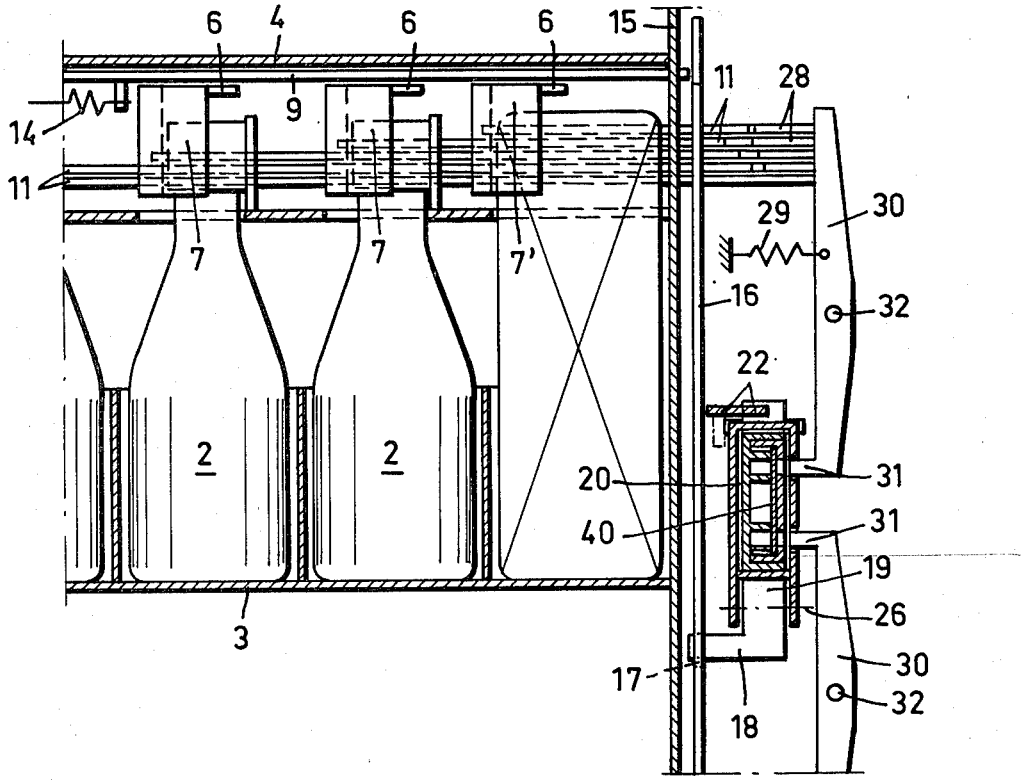
FIG. 2 is the vending machine locking device of FIG. 1 presented schematically in simplified side view.
Figure 3:
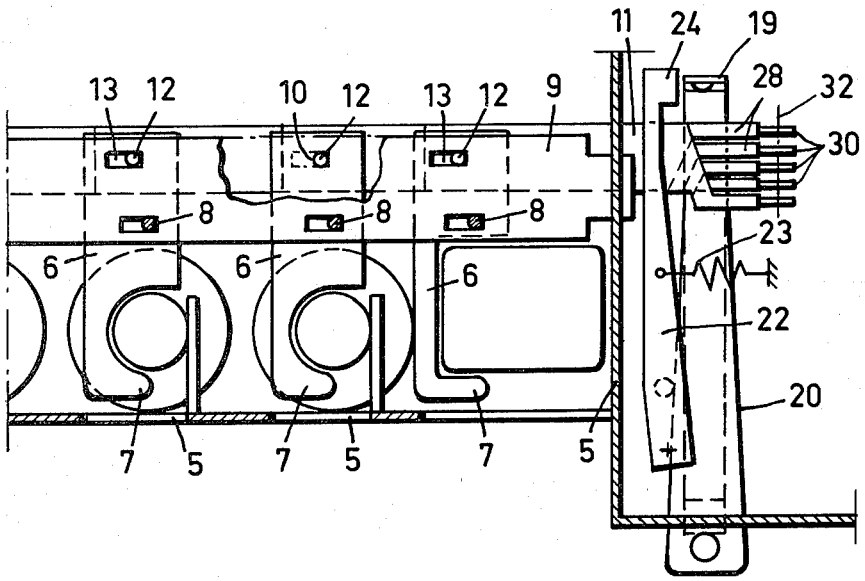
FIG. 3 is a top plan view of locking device of FIG. 2

As is seen from FIGS. 1 through 3, slots 5 are closed at least partially by locking elements 6, made in form of relatively thin metal sheet strips embracing bottle neck at least partially with their hooklike ends or locking hook 7. These locking elements 6 are supported in their middle portions through king pins 8 by guide rail 9 extended along the total row length and every locking element 6 has on its rear part an orifice 10, with which pin 12 engages, mounted on every push rod 11 with a length, reaching the corresponding section. Further pins 12 engage slots 13 in form of rectangular holes in the passing through guide rail 9.

FIG. 2 shows the guide rail 9 loaded by spring 14, as it passes through corresponding orifice in housing internal partition 15. Near this internal partition 15, the locking bar 16 is installed for movement in a vertical plane having in its middle zone, a slot 17 to accept the sharp end 18 of angular lever 19. Guide rail 9, angular lever 19 and locking bar 16 are the details of interlocking device, which initially and until the would-be withdrawal of one of the bottles, should be set up in its unlocked position.

The unlocked position is obtained by actuating key 20 being inserted into corresponding orifice 21 formed in the housing. Upon insertion of the actuating key, two anti-theft plates 22 adjacent to the housing are pivoted against the force of spring 23 so that their front hooks 24 disengage angular lever 19 loaded by spring 25. Further actuating key 20 insertion into the housing orifice causes locking lever 19 to pivot around rotation point 26 (FIG. 4) against force of swings overcoming the force of spring 25, Because of this pivot movement, locking bar 16 moves in vertical plane into its bottle disengaged position, after which the selected bottle can be withdrawn out of the corresponding section.

This bottle withdrawal causes locking hook 7 to pivot about its respective king pin 8 causing horizontal movement of push rod 11 relating to said locking hook. As is seen from FIG. 3, every push rod 11 has on its right end, pins 28 which according to FIGS. 2 and 4, interact with swing levers 30 which are loaded by springs 29. These tow-armed swing levers 30 have on one end the sharp stamping punches 31. Through the horizontal movement of push rod 11, formed as stamped metal sheet web, the swing lever 30 which respectively interacts with the displaced push rod 11, is pivoted around swing lever pivot 32, so that is stamping punch 31 passes through an opening suitably located in fully inserted actuating key 20 and provides a mark in a papermatrix which is safely located within the actuating key. This hole marking informs the party doing the billing that a bottle related to this field in the matrix was withdrawn fom the vending machine.

Actuating key 20 shown separately in FIGS. 6 and 7 consists of housing 35 made in form of a blunt-edged blade. This housing has on its one end a protruding portion 36, which serves as a handle. The protruding portion 36 is provided with a sleeve 36*a* for carrying a room key. It can be seen from FIG. 7 that a cover 37 is one-sidely pivoted to housing 35. In this cover are provided in predetermined space arrangement or layout, i.e. here in two rows, a marking media or matrix 40.

FIG. 6 illustrates that several pins 39 secured to cover 37 and which have the function of key bit. The paper matrix 40, the top plan view of which is shown in FIG. 7 and one which are imprinted squares 40*a*, corresponding to the number and location of cover holes 38 disposed inside cover 37. Upon withdrawal of one bottle from a single vending machine section, a perforation is performed through leverage 11, 30 and stamping punch 31 on the paper matrix corresponding square 40, which shows the party doing the billing that this special bottle has been withdrawn from vending machine.

In order to avoid paper matrix withdrawal by unauthorized persons, the matrix has the form of single paper strip and is protected by a closing mechanism in housing 35 in detail in FIG. 7A. This mechanism allows opening of cover 37 only by means of special tools. This closing mechanism consists of hook 41 which is spring loaded in position in housing 35 and is formed so that it snaps into a hollow or recess in cover 37. A balance element 42 is influenced by draw spring 43, and is pivoted on hook 41. Hook 41 is removably mounted on guideways 44, and can be removed only when balance 42 is leveled horizontally or exactly in parallel with guideways 44. In every other position, the balance element 42 runs into the edges of guideways 44 and the cover remains in its interlocked position. Given this construction opening of the cover can be accomplished only by exact and straightened insertion of two pins one removed from another (not shown in the drawings) into the orifice 45 on the front side of actuating key housing 35.

The above presented description of interlocking and operating device relates only to one of rows 2*a*, 2*b*, 2*c* shown in FIG. 1. It is however obvious, that in the corresponding device, every row has in construction equally or similarly formed mechanisms, as illustrated e.g. in FIGS. 4 and 5.

In each section, at the same time, there can be placed one bottle as illustrated in FIG. 1. In order to make it possible to place bottles of middle sizes, loose supporting disks 50 which serve as height compensators are provided.

The vending machine according to the invention is suitable not only for bottle dispensing, but it is also possible to place containers, e.g. cigarette packages stacked one above another in a certain number of sections as shown in the lower right of FIG. 1. In this case the corresponding section is closed on the front side by a wall, on which e.g. it is possible to put an identifying list of items contained in the section. Locking hook 7 of this section is lenthened, and the corresponding slot 5' are correspondingly widened.

According to this invention it is possible to provide on the vending counter an electromagnetical timing device connected with interlocking device, this timing device prevents release of articles from certain sections containing e.g. alcohol drinks in predetermined time spans.

What is claimed is:

1. In a vending machine comprising, a housing, separate lockable sections disposed in said housing, each of said sections being divided into rows for holding articles to be dispensed, and provided with locking elements, lever means for locking and unlocking of the locking elements of said lockable sections, a stamping mechanism which includes a number of stamping punches corresponding to the number of said sections in the machine and being operable individually by pivoting of respective locking elements, an interlocking device operatively connected to the lever means to cause the same to selectively engage the locking elements, and an actuating key inserted into a correspondingly shaped openings in said housing for actuating the interlocking device and unlocking the locking elements of said sections, said actuating key including a matrix for the stamping punches, subdivided into fields, the improvement which comprises:

a plurality of push rods being formed of a narrow sheet metal web, and arranged one above another in said housing so as to be movable longitudinally therein, said push rods engaging the stamping mechanism in response to withdrawal of an article from the vending machine, the locking elements being formed of locking hooks pivotally mounted on said push rods, the lever means including a guide rail member for engaging the locking elements, the interlocking device comprising a vertical locking bar for engaging said guide rail member, an angular lever which engages said vertical locking bar, and at least one spring biased anti-theft plate actuated by said actuating key to pivot against the force of the spring relative to said vertical locking bar, and disengage the angular lever, and said actuating key which acts on said anti-theft plate comprising a housing having orifices disposed on one side thereof and an interchangeable stamping matrix disposed therewithin.

2. A vending machine as claimed in claim 1, wherein said actuator key comprises a cover, a cover opening and closing mechanism including hook means supported on said cover and movable on a guideway against the force of a spring.

3. A vending machine as claimed in claim 1, wherein said actuator key comprises a cover, a cover opening and closing mechanism, which mechanism further comprises hook means supported in said cover and movable on a guideway against a spring force, and a pivoted balance member which permits movement of said hook means when the balance means is levelled and parallel to the guideways.

4. A vending machine as claimed in claim 1, wherein said anti-theft plate includes tappets, the form and location of which fit the shape of the housing of said actuating key.

5. A vending machine as claimed in claim 1, wherein said actuating key comprises, a housing formed in the shape of a blunt-edged blade, a cover pivoted to the blade-shaped housing and having orifices for the passage of said stamping punches, and an opening and closing mechanism disposed in the blade-shaped housing and engaging said cover.

6. A vending machine as claimed in claim 5, wherein the blade-shaped housing of said actuating key has a protruding portion which serves as a handle, and a sleeve provided in said protruding portion for carrying a room key.

7. A vending machine as claimed in claim 5, wherein said cover has a recess and the opening and closing mechanism of said actuating key comprises, a spring-loaded hook member resiliently mounted in the blade-shaped housing and snapping into said recess of said cover, guideways for engaging said hook member, and a pivotable balance member pivoted on said hook member and cooperating with said guideways, said hook member being movable on said guideways against the force of a spring when the pivotable balance member is leveled in parallel with said guideways.

* * * * *